United States Patent [19]

Ehlus et al.

[11] Patent Number: 4,607,473

[45] Date of Patent: Aug. 26, 1986

[54] APPARATUS FOR HANDLING FLAT, FLEXIBLE WEB PRODUCTS

[75] Inventors: Dennis W. Ehlus, Green Bay; Patrick J. Williams, Hobart, both of Wis.

[73] Assignee: Paper Converting Machine Company, Green Bay, Wis.

[21] Appl. No.: 667,090

[22] Filed: Nov. 1, 1984

[51] Int. Cl.[4] ..... B65B 57/00

[52] U.S. Cl. ..... 53/54; 53/120; 53/249; 53/540; 271/279; 414/46; 414/53

[58] Field of Search ..... 53/54, 117, 120, 247, 53/249, 535, 540; 198/696; 209/539; 271/82, 279, 300, 302, 303, 305; 414/46, 53, 81; 493/405, 419, 451, 457

[56] References Cited

U.S. PATENT DOCUMENTS

| | | | |
|---|---|---|---|
| 3,284,081 | 11/1966 | Huck | 271/300 |
| 3,523,400 | 8/1970 | Daily | 53/117 |
| 3,599,805 | 8/1971 | Spencer | 271/218 |
| 3,640,050 | 2/1972 | Nystrand et al. | 53/120 |
| 3,805,482 | 4/1974 | O'Shea et al. | 53/120 |
| 3,851,773 | 12/1974 | Kluge et al. | 414/81 |
| 3,919,827 | 11/1975 | Larson et al. | 53/120 |
| 4,495,745 | 1/1985 | Crescenzo et al. | 53/234 |

FOREIGN PATENT DOCUMENTS

| | | | |
|---|---|---|---|
| 711888 | 7/1954 | United Kingdom | 271/300 |

*Primary Examiner*—John Sipos
*Assistant Examiner*—Donald R. Studebaker
*Attorney, Agent, or Firm*—Tilton, Fallon, Lungmus & Chestnut

[57] ABSTRACT

Apparatus for handling a stream of flat, flexible web products where first and second gripper means are disposed to intersect said stream for tandem operation, and with means operably associated with the first gripping means for deactivating the same after a predetermined number of web products has been gripped.

6 Claims, 15 Drawing Figures

F
W
12
13
14
15
16
17
18
19
20
21
22
23
24
25
26
27
77
92
99
100
8

FIG. 2
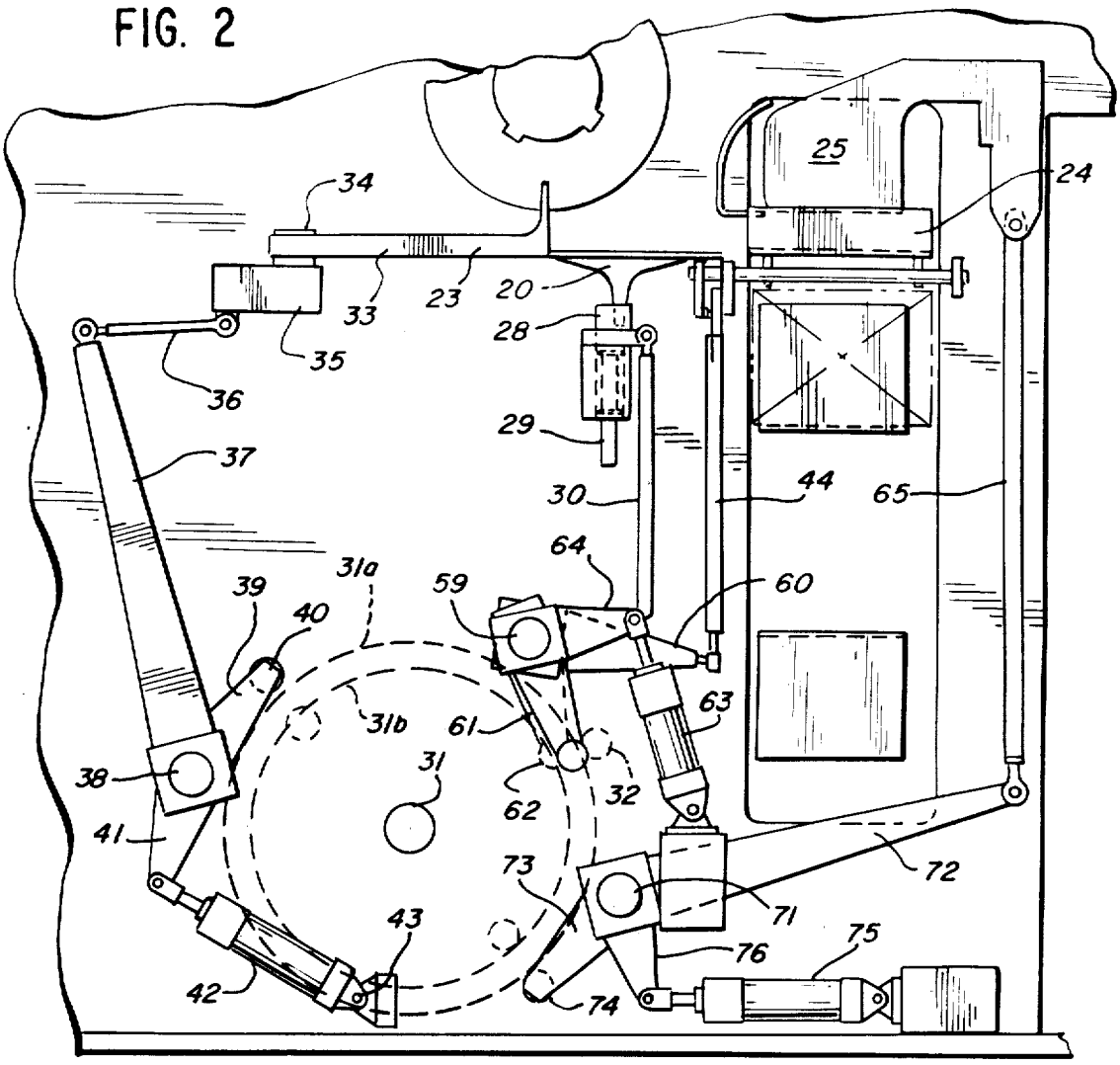
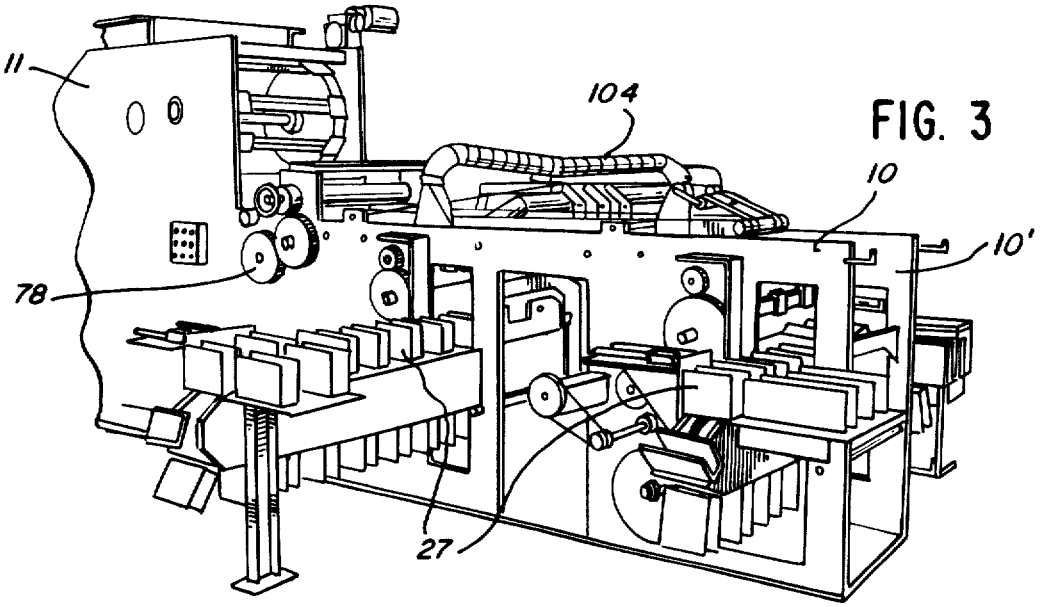
FIG. 3

APPARATUS FOR HANDLING FLAT, FLEXIBLE WEB PRODUCTS

BACKGROUND AND SUMMARY OF INVENTION

This invention relates to apparatus for handling flat, flexible web products and more particularly, to such items as plastic food bags.

In the past, such products have been presented to the consumer either in roll form from which the bags are detached along lines of transverse perforation or having a predetermined number in a carton. The instant invention relates to the latter category. A prior machine for boxing bags is co-owned U.S. Pat. No. 3,640,050. The instant invention finds advantageous use for similar products.

The instant invention, like the '050 patent, handles a stream of bags but differs significantly in the apparatus for the handling and ultimate boxing or cartoning. A significant feature of the invention resides in the apparatus for sequential handling of the bags involving gripping means.

Although the gripping means per se are known (see co-owned U.S. Pat. No. 3,599,805) there has been no teaching of utilizing a pair of gripping means operating in tandem. According to the invention, the gripping means first in the path of the stream of web products sequentially grips these products and assembles them into a stack—containing a predetermined number.

Thereafter, the first gripping means is deactivated and the web products continue in the path to a second gripping means which assembles another stack while the machine elements associated with the first gripping means are completing the folding and cartoning of the first developed stack. This arrangement makes possible significantly greater speed of operation while still maintaining positive control over the flexible web products, i.e., the bags.

More particularly, the deactivation of the first gripping means is accomplished by a unique "phasing" of the gripper actuating cam which facilitates the advantageous high speed operation. The deactivation of the gripping means can also be applied to the second gripping means, thereby achieving a "cull" mode of operation which is used on occasion to reject sub-quality bags or during adjusting/maintenance periods of operation.

Other objects and advantages of the invention may be seen in the details of the ensuing specification.

The invention is described in conjunction with an illustrative embodiment in the accompanying drawing, in which FIG. 1 is a side elevational view, partially schematic, of apparatus for practicing the invention;

FIG. 2 is a fragmentary side elevational view showing certain of the cam actuated mechanisms associated with each of the gripper means of FIG. 1;

FIG. 3 is a perspective view of the overall apparatus;

DETAILED DESCRIPTION

Figures 1, 1A, 1B, 1C, 1D, 1E, 1F, 1G, 1H:
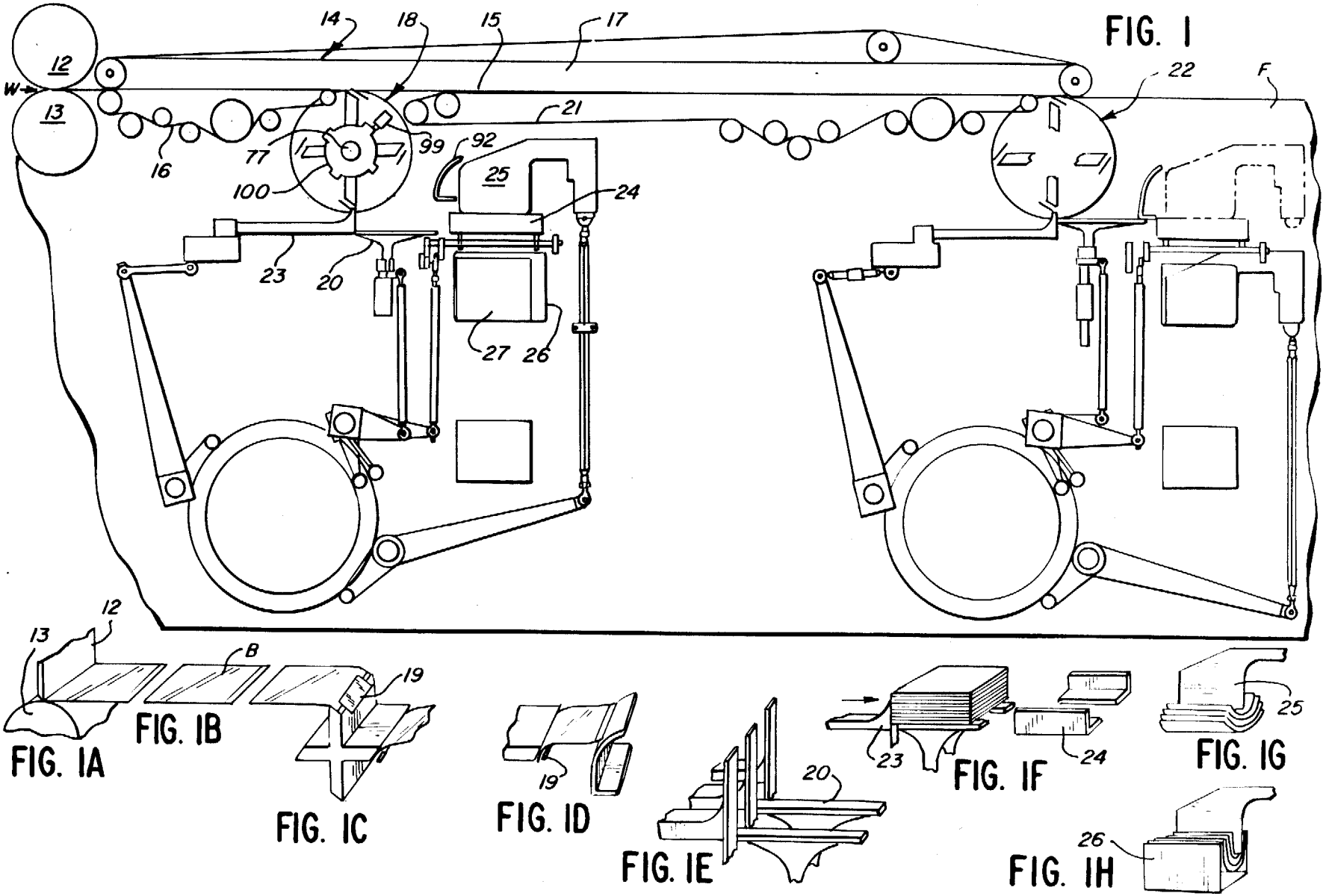
FIGS. 1A-1H are schematic perspective views of the sequence of steps performed by the apparatus of FIG. 1.
Figure 4:
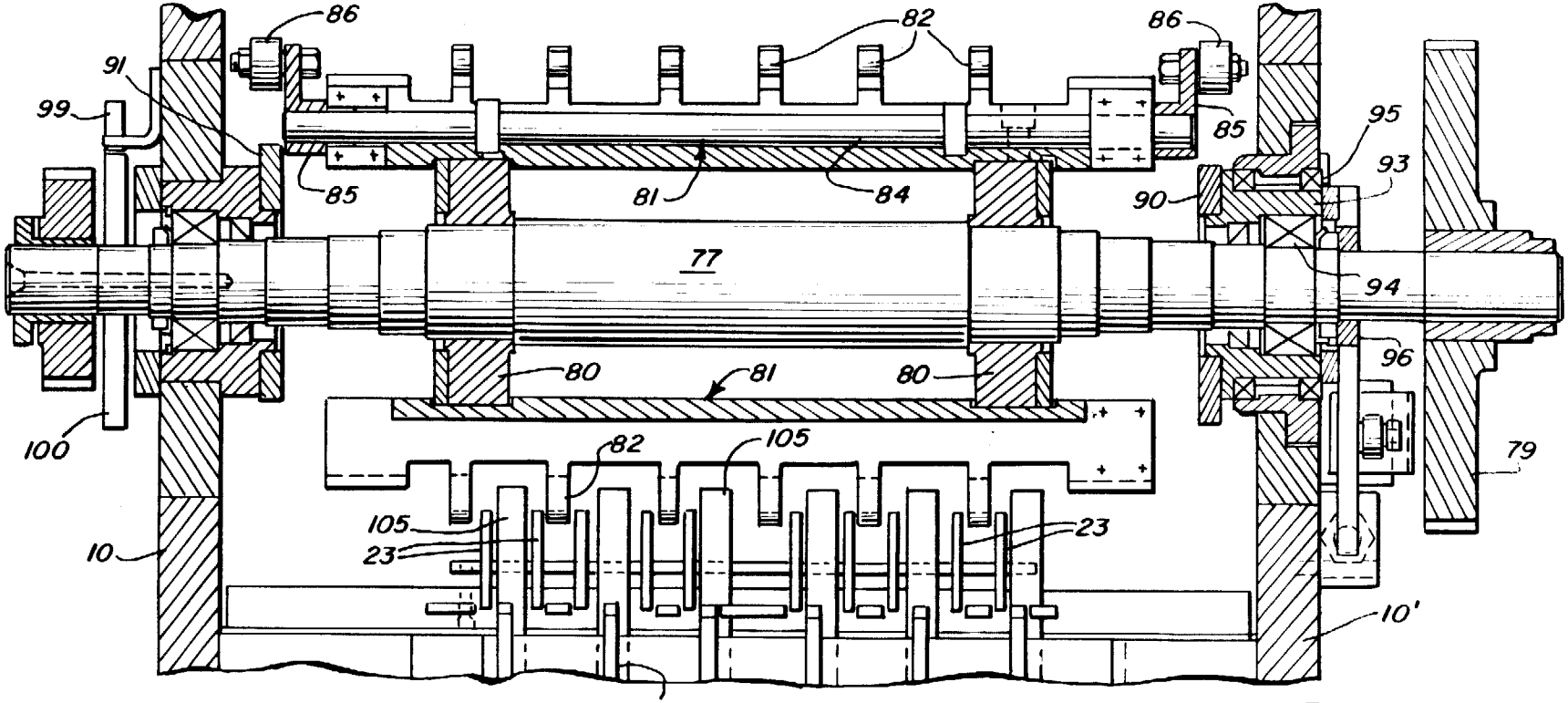
FIG. 4 is a transverse sectional view of the apparatus of FIG. 1 and showing particularly the arrangement of the gripping means.

Referring first to FIG. 1, the symbol F designates the frame of the web product handling apparatus which is seen to include side frames 10 and 10'—see the lower portion of FIG. 4. The overall arrangement of the machine can be seen in FIG. 3 where the numeral 11 in the upper left denotes a bag sealer, i.e., a machine for developing transverse seals in a layered web.

In the illustration given, the transverse seals do not effect separation of the continuous layered web into discrete products, viz., individual bags. That function is performed by the knife roll 12 operating against an anvil roll 13 seen in the upper left hand portion of FIG. 1. This step is schematically illustrated in FIG. 1A where a discrete bag B is seen in the process of being formed.

Operation Generally

After a bag has been developed by cutoff, it enters a speed-up conveyor generally designated 14 and which includes an upper belt run 15 and a lower belt run 16. The belts 15 and 16 are operating at a speed faster than the speed of advance of the web entering the cutoff station made up of the rolls 12 and 13. This results in the bags being spaced apart as illustrated in FIG. 1B.

To maintain control over the individual bags B, the upper belt 15 is made of screening and runs under a vacuum box or manifold 17. The bags next encounter a first gripping means generally designated 18 and which is made up of a plurality of grippers 19—see the upper central portion of FIG. 6.

The grippers sequentially grip the bags B in the stream being conveyed by the belt system 14 and move the bags serially around an arcuate path to be deposited on an elevator 20.

After a predetermined number of bags have been deposited on the elevator 20, the deactivating means depicted in FIG. 6 (to be described hereinafter) cause the grippers 19 to be closed, thus permitting the stream of bags to continue under the influence of vacuumized screen belt 15 and a second lower belt 21 until they reach the second gripping means generally designated 22.

Meanwhile, the bags removed from the stream by the first gripping means 18 are proceeding through the operational steps depicted in FIGS. 1C as to gripping, 1D as to rotating through an arcuate path and 1E as to stacking on the elevator 20. Thereafter, a pusher 23 is activated to translate horizontally the stack of predetermined number of web products onto a split tray 24—this being depicted in FIG. 1F.

Thereafter, a tamper 25 moves downwardly in the fashion depicted in FIG. 1G—and while the split tray is opening—to fold the stack and simultaneously introduce it into a carton 26. The cartons are arranged on a conveyor 27 extending transversely of the length of the frame F as also can be appreciated from a consideration of FIG. 3.

Elevator Actuating Means

Reference is now made to the central part of FIG. 2 where the elevator is again designated 20 and is seen to be slidably mounted in a sleeve 28 fixed to the frame F. The elevator 20 also includes a depending rod 29 (shown in its lowermost position in dotted line). The rod 29 is connected to a cam actuated linkage 30.

Rotatably mounted in the frame F is a cam shaft 31 which carries four different cams, one of which is used to actuate the elevator 20. For ease of clarification, only the inner and outer diameters of one of the cams are shown in dotted line and designated 31*a* and 31*b*. The other cams are employed for actuating the pusher 23, the split tray 24 and the tucker 25.

The linkage 30 terminates, at its lower end, in a cam follower 32. As the elevator cam rotates, the cam follower 32 follows the periphery and moves in and out to develop a vertical motion for the elevator 20.

Pusher Actuating Means

Still referring to the upper central part of FIG. 2, the numeral 23 again designates the pusher for translating a stack of web products horizontally. The pusher 20 also has an extending rod—this time horizontal and designated by the numeral 33. The rod 33 is equipped with a bracket 34 which slides in a block 35. Connected to the bracket 34 is a cam actuated linkage 36. This includes a generally vertical arm 37 which, at its lower end, is fixed to a pivot shaft 38—the shaft 38 being journalled in the frame F.

Also fixed to the pivot shaft 38 is a cam follower arm 39 carrying a cam follower 40. To insure that the cam follower 40 bears continually against the periphery of its associated cam, the pivot shaft 38 is equipped with yet another arm 41 which is air loaded by means of an air cylinder 42 pivotally connected to the frame F as at 43. Pressure within the cylinder 42 insures that the cam follower is urged against the periphery of the cam.

No such urging means is associated with the elevator linkage 30 because the weight of the system insures continual bearing of the cam follower 32 against its associated cam.

Split Tray Actuating Means

Figure 5:
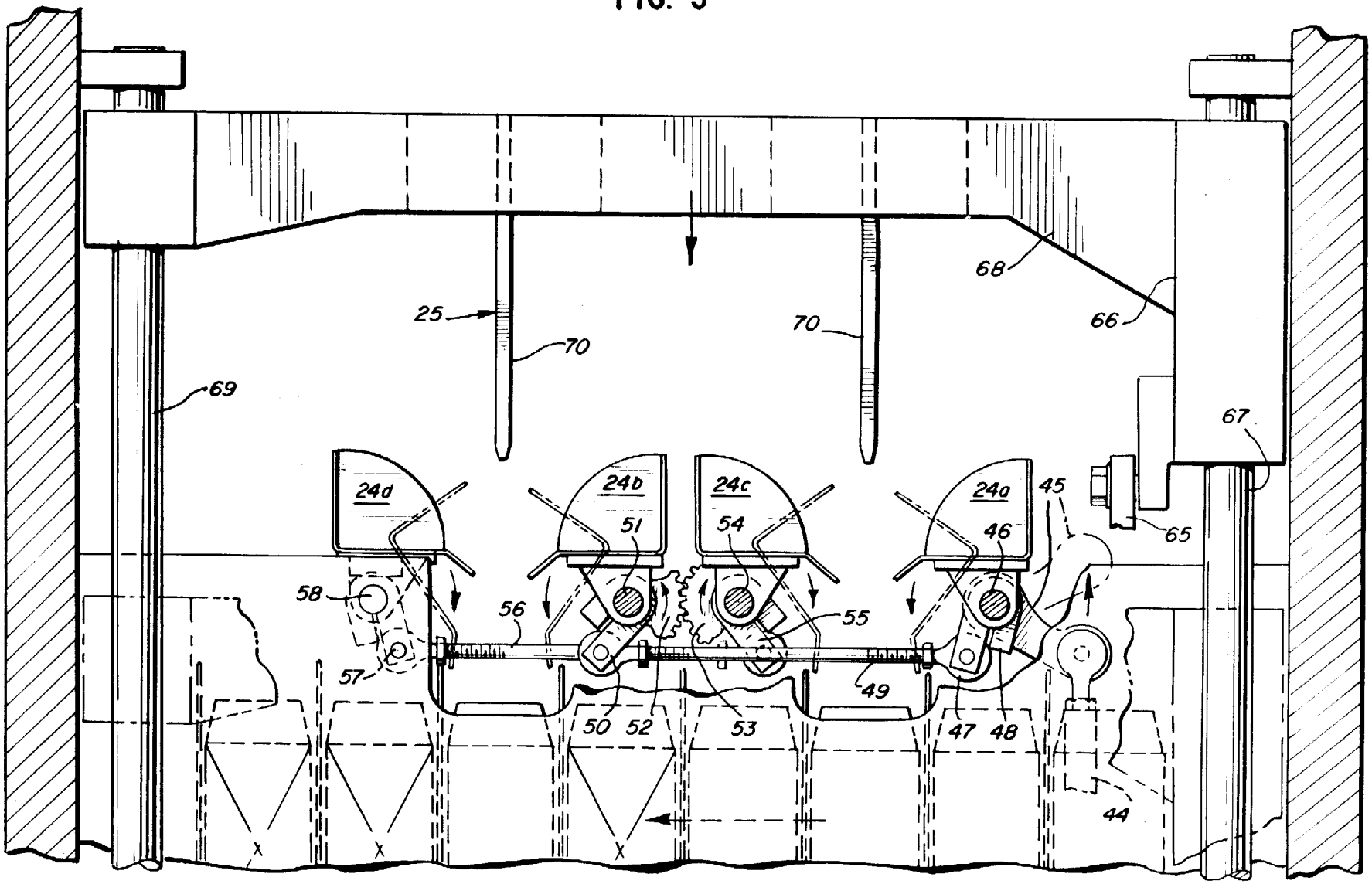
FIG. 5 is another transverse sectional view and which shows particularly the tucking means employed for cartoning.

Still referring to the upper portion of FIG. 2, the numeral 24 again designates the split trays which receive a stack of web products from the elevator 20 under the urging of the pusher 23. These split trays can be seen in greater detail in FIG. 5. The trays are controlled by a cam actuated linkage 44 (compare FIGS. 2 and 5). In FIG. 5, there are four tray segments 24*a–d* provided—the usual arrangement in bag sealing machines being to operate two parallel lanes through the bag sealer and delivery end.

Referring to FIG. 5, the upper end of the linkage 44 has pivotally connected thereto a rocker arm 45. This in turn is clamped to a rocker shaft 46. The rocker shaft in turn is connected by means of a rigid connection 47 (shown in dotted line) in connection with the dotted line showing of tray 24*a* in the discharge mode.

A block 48 is also clamped to the rocker shaft 46 and is pivotally connected by means of a connecting rod 49 to a clamp block 50 fixed to the rocker shaft 51 controlling the tray segment 24*b*. Thus, these segments operate in unison.

Also carried by the rocker shaft 51 is a gear 52 which is in engagement with a mating spur gear 53 fixed to the rocker shaft 54. The rocker shaft 54 carries the tray segment 24*c* and thus that tray segment operates in synchronism with the previously mentioned tray segments 24*a* and 24*b*. Block 55 is clamped to the rocker shaft 54 and through connecting rod 56, clamp block 57 and rocker shaft 58 transmits motion to the left hand most tray segment 24*d*—whereby all of the four segments 24*a–d* operate in synchronism to discharge web products from the two lanes.

For actuating the linkage 44—and here, reference is now made to FIG. 2—a rocker shaft 59 is pivotally mounted within the frame F. The rocker shaft 59 has fixed thereto a rod 60 constituting the lower portion of the linkage 44. Also fixed to the rocker shaft 59 is a cam follower arm 61 carrying a cam follower 62—which rides against its associated cam. To insure that the cam follower 62 bears against the periphery of its cam, it is air loaded by means of an air cylinder 63 operating through an arm 64 also fixed to the rocker shaft 59.

Tamper Actuating Means

Referring again to the upper portion of FIG. 2, the tamper is again designated 25 and is seen to be connected to a cam actuating linkage 65. This linkage can also be seen in the right central portion of FIG. 5 where it is connected to a slide 66 guided on a rod 67. The block 66—at its upper portion—carries the tucker carriage 68. The left hand portion of the carriage 68 is slidably mounted on a fixed rod 69 generally similar to the rod 67. Thus, under the influence of the cam actuated linkage 65, the tucker carriage 68 moves up and down. Fixed in depending relation to the carriage 68 are the two tucker plates 70—one for each lane of web product. These descend between the split trays to fold the web product for introduction to the ultimate cartons.

Referring once again to FIG. 2, the linkage 65 is generally similar to that previously described with respect to the pusher 23 and the split trays 24. In other words, a rocker shaft 71 is rotatably mounted in the frame F and has fixed thereto a connecting arm 72 forming part of the linkage 65. Also fixed to the rocker shaft 71 is a cam follower arm 73 carrying a cam follower 74. Urging the cam follower 74 against the periphery of its associated cam is an air cylinder 75 operating through a rocker arm 76 fixed to the pivot shaft 71.

Gripper Construction

Figure 7:
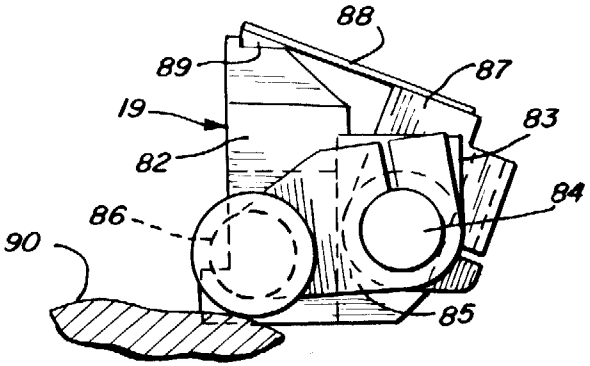
FIG. 7 is an enlarged fragmentary side elevational view of one of the grippers employed in the practice of the invention.
Figure 6:
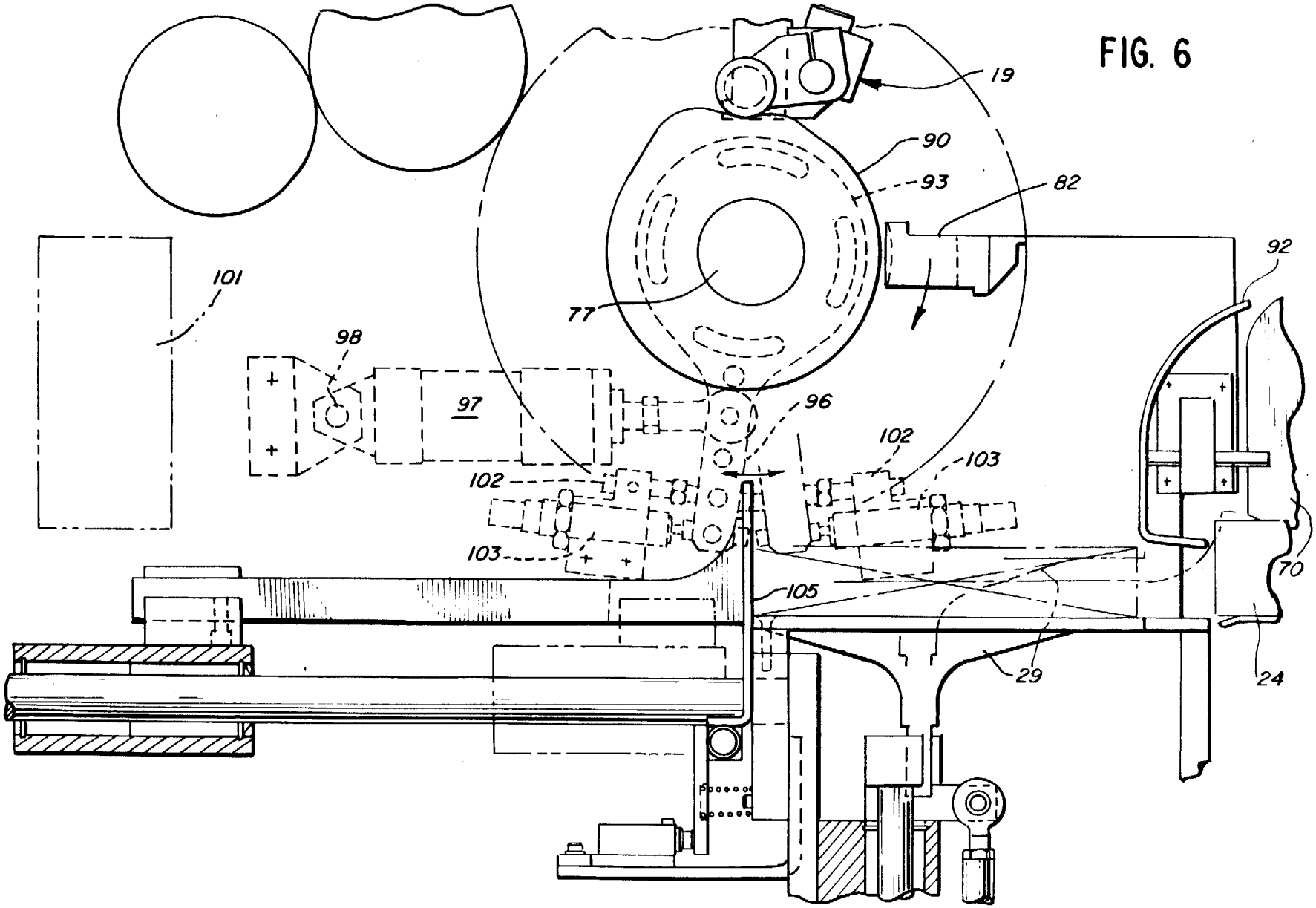
FIG. 6 is an enlarged fragmentary side elevational view of the gripping means of FIG. 1 and which features the details of the "phasing" mechanism.

Referring now to FIG. 6, the numeral 77 (see the upper right central portion) designates a driven shaft rotatably mounted in the frame F. For clarity of presentation, the gear drive to this shaft is omitted in FIG. 6 but the drive generally for the various rotating shafts can be appreciated from a consideration of the central left hand portion of FIG. 3 where the gear train drive is designated 78. The particular gear 79 driving the gripper shaft 77 can be seen at the extreme right hand portion of FIG. 4. Still referring to FIG. 4, it will be seen that a pair of spiders 80 are provided on the shaft 77 which carry the plurality of anvil supports generally designated 81. In the illustration given, four such supports are provided with the anvils being positioned 90° apart. This can be appreciated from a consideration of FIG. 6 where anvils 82 are illustrated in the 12 o'clock and 3 o'clock positions—see the upper central portion of FIG. 6. Each anvil support 81 carries a plurality of anvils 82 as can be appreciated from a consideration of FIG. 4. Referring now to FIG. 7, it will be noted that the anvil 82 has fixed thereto a block 83 which carries a rocker shaft 84. Clamped to the rocker shaft 84 is a cam follower arm 85 which in turn carries a cam follower 86.

Also fixed to the rocker shaft 84 is a gripper finger mount 87. This carries a gripper finger 88 which cooperates with the anvil 82 in gripping web products. In particular, each anvil 82 has a notch at the upper portion confronting the finger 88 which is equipped with an anvil pad 89.

The cam which actuates the cam follower 86 is shown in fragmentary form in FIG. 6 and designated 90. This cam is also seen in the right hand portion of FIG. 4. The cam 90 operates against the right hand cam follower 86 to close the gripper fingers 88 incident to pickup of the web product. The left hand cam follower 86 operates against a cam 91 on the left hand side of FIG. 4 and is operative to open the gripper fingers 88 and thus release the web product onto the elevator 20.

When the first gripping means 18 is being employed to deposit web products on the elevator 20, the cam 90 is positioned to close the gripper fingers 88 against the anvil pad 89 at shortly before the 12 o'clock position. The web product is then carried through an arc of about 180° for deposit on the elevator 20. The trailing edge of the web product is maintained in position by moving along the guide fingers 92. To effect discharge of the web product for proper deposit on the elevator 20, the cam 91 is contoured so as to present a high point or profile to the cam follower 86—thereby pivoting the rocker shaft 84 and opening the gripper fingers.

When the tandem operation is employed—utilizing the second gripping means 22 to grip and stack an alternate series of bags, the gripper fingers 88 on the first gripping means 18 are closed in advance of the 12 o'clock position—approximately 15° sooner. This is achieved by rotating the cam 90—the "pick-up" cam 15° and the mechanism for this has been referred to previously as the "phasing" mechanism.

PHASING MECHANISM

Reference is now made to FIG. 6 and in the upper central portion the cam 90 is identified and which is carried by a bracket 93 rotatably mounted on the shaft 77. The precise mounting can be appreciated from the right hand portion of FIG. 4 where the bracket or cartridge 93 is seen to be mounted on a roller bearing 94 which in turn is mounted on the shaft 77. The entire assembly is journalled within the side frame 10' by means of another roller bearing 95.

The cartridge 93 is actuated by an arm portion 96 (see also FIG. 6). The actuation is provided by a cylinder and piston rod unit 97—see the central portion of FIG. 6—which is pivotally mounted as at 98 on the frame F.

Thus, when it is indicated to go to the tandem operation—utilizing the second gripping means 22—the cylinder and piston rod unit 97 is actuated to rotate the cartridge 93 and the cam 90 so as to close the gripper fingers 88 ahead of the "pick-up" position which is normally a few degrees ahead of the 12 o'clock position. In such a case, the web product then passes over the first gripping means 18 and under the influence of the vacuum-assisted belts 15 and 21 passes onto the second gripping means 22.

The signal for switch to the tandem operation is provided by a proximity switch 99—see the left upper portion of FIG. 1. The proximity switch operates in conjunction with a counter 100 mounted on the shaft 77 of the first gripping means. Reference to FIG. 1—and also the upper central portion of FIG. 2—reveals that the counter 100 has four lobes, so that three revolutions of the shaft 77 represents a stack of 12 web products—which triggers the proximity switch to actuate a solenoid valve 101 (see the extreme left hand portion of FIG. 6) to in turn actuate the unit 97.

Because of the high speed operation I have found it advantageous to provide decelerating means for the unit 97. These are used in conjunction with stop means which are designated 102 in the central portion of FIG. 6. Thus, the arm 96 can rotate through about 15° between the two stops 102. To cushion the rapid action, I provide shock absorbers in the form of air cylinders 103 which, like the stops 102, are fixed to the frame F so as to decelerate the movement of the arm 96 as it approaches one of the stops 102.

Operation

A continuous web W (see the upper left hand portion of FIG. 1) which has been transversely sealed at longitudinally spaced areas is introduced into a cutoff station. The cutoff station includes knife and anvil rolls 12 and 13 which sever the tube in the areas of sealing so as to provide a stream of individual web units such as food bags—see also FIG. 1A. The individual bags are introduced into a speed-up conveyor consisting of an upper belt 15 and a lower belt 16 which provides the spacing between successive bags illustrated in FIG. 1B. The bags are urged against the upper belt 15 by means of a vacuum assist developed through the manifold 17 which is coupled to a vacuum blower (not shown) by means of a flexible conduit 104—see the upper central portion of FIG. 3.

The bags or other web products continue along the speed-up conveyor 14 until they reach the first gripping means 18—see FIG. 1. These are then gripped by the gripper 19 illustrated in FIG. 7 which has an anvil 82 against which a gripper finger 88 operates. The cam 90 is profiled to close the gripper finger 88 at the appropriate point and thus the web product so gripped is carried by the first gripping means 18 through an arcuate path. The first gripping means 18 includes a rotating shaft 77 (see FIG. 4) which carries the anvils and gripper fingers. After about 180° rotation—the trailing edge of the web unit being guided by the guide fingers 92—the bag or web product is released by the action of a second cam 91—see the left hand portion of FIG. 4. This results in the product being deposited on the elevator 20—see FIG. 1. The height location of the elevator 20 is determined by a cam mounted on the cam shaft 31—see the lower left hand portion of FIG. 2 and which operates through a cam linkage 30.

When a predetermined number of bags or other web units are accumulated on the elevator 20—as sensed by the proximity switch 99 operating in conjunction with the counter 100 (see also the left hand portion of FIG. 4 as well as the upper left hand portion of FIG. 1—a signal is delivered to a solenoid actuated valve 101—see the left hand portion of FIG. 6. This actuates the cylinder and piston rod unit 97 (central portion of FIG. 6) to pivot the "pick-up" cam 90—thereby closing the gripper fingers 88 ahead of the pick-up position. Web product thereupon continues past the first gripping means 18 and is handled by the second gripping means 22. The further handling of bags at the second gripping means 22 follows the same procedure as that followed with respect to the first gripping means.

In other words, after a predetermined number of bags or web products are accumulated on the descending elevator 20, a pusher 23 is actuated by its cam on the cam shaft 31 through linkage 36 to move the pusher 23 to the right and deliver the now completed stack to the split trays 24.

I provide stop fingers (best seen in the lower portion of FIG. 4 as at 105) to prevent misoperation of the pusher 23. For example, if web units are deposited on the elevator 20 while the pusher 23 is in its extreme right position, the stop fingers prevent these web products from being moved to the left by the pusher upon its return and thereby foul the machine. When the stop fingers are engaged by web units in such missoperation, the apparatus is shut down.

The split trays can be seen in FIG. 5 and relative to the right hand most tray 24*a*, the two positions are indicated. The trays are opened under the influence mounted on a cam shaft 31 operating through a linkage 44 to permit deposit of the stack into a carton. Incident to this deposit, the tucker generally designated 25 which includes a pair of tucker blades 70 moves downwardly under the actuation of an associated cam on the cam shaft 31 operating through linkage 65. These cause folding of the stack incident to deposit in the cartons which are conveyed by the conveyors 27 for each of the gripping units (see FIG. 3).

By introducing a phasing unit such as that depicted in FIG. 6, relative to the second gripping means, a "cull" operation can be performed. In other words, a bag or web unit which is unsatisfactory can be made to bypass not only the first gripping means 18 but the second gripping means 22 as well.

With the apparatus just described, it is possible to achieve heretofore unattainable production speeds while the bags are under positive control and without the need of handling mechanisms that are unduly complicated.

While in the foregoing specification a detailed description of an embodiment of the invention has been set down for the purpose of explanation, many variations in the details hereingiven may be made by those skilled in the art without departing from the spirit and scope of the invention.

I claim:

1. Apparatus for handling a stream of flat, flexible web products comprising a frame defining the sides of a product path, means for introducing said products sequentially into said path, first gripping means rotatably mounted on said frame for movement through a predetermined location in said path and equipped with a plurality of closeable grippers having means to positively grip said products and deposit a predetermined number in superposed relation to form a stack, means operably associated with said first gripping means for deactivating the same by closing said grippers before said grippers rotate into said predetermined location and after said predetermined number of products has been gripped, so that said products pass through said predetermined location without being gripped by said first gripping means and second gripping means on said frame in a continuation of said path also having means to grip the products that passed ungripped through said predetermined location and deposit the same in superposed relation to form a stack.

2. The apparatus of claim 1 in which cam means are provided on said frame for opening each of said grippers just prior to the passage of each of said grippers through said path predetermined location and for closing each of said grippers shortly thereafter, said means for deactivating said first gripping means including means for rotating said cam means to both open and close each of said grippers prior to the passage of each of said grippers through said path predetermined location.

3. The apparatus of claim 1 in which means are operably associated with said first and second gripping means to deactivate the same to cull a selected product.

4. The apparatus of claim 1 in which each of said closeable grippers includes an anvil and a gripping finger, cam means on said frame for actuating said gripping fingers, and means operably associated with said cam for closing said gripping fingers prior to the entry thereof into said path location.

5. The apparatus of claim 4 in which said means operatively associated with said cam includes an air cylinder and piston rod unit operating against a fixed stop, and shock absorber means associated with said piston rod to decelerate the same before reaching said fixed stop.

6. Apparatus for alternately developing stacks of plastic bags for folding and cartoning one stack while the other is being developed comprising a frame, upper and lower belt systems movably mounted on said frame defining a path for advancing bags sequentially therealong, said lower belt system being interrupted at one location in said path, a first bag gripping means rotatably mounted in said frame and arranged to intersect said path at said location, a plurality of grippers on said gripping means each having a closeable jaw for positively clamping bags in sequence, cam means on said frame for positioning said jaws in open position as each jaw passes said path location and promptly thereafter closing said jaws to positively grip a predetermined number of bags in sequence, and control means on said frame for adjusting said cam means for closing said jaws prior to reaching said path location so that bags are conveyed ungripped through said location by said upper belt system to a second gripping location in said path, said second gripping location having grippers to grip said previously ungripped bags and bag folding and cartoning means on said frame adjacent said first bag gripping means.

* * * * *

UNITED STATES PATENT AND TRADEMARK OFFICE

CERTIFICATE OF CORRECTION

PATENT NO. : 4,607,473

DATED : August 26, 1986

INVENTOR(S) : Dennis W. Ehlers et al.

It is certified that error appears in the above-identified patent and that said Letters Patent is hereby corrected as shown below:

On the title page, the first inventor's name should read

-- Dennis W. Ehlers --.

Signed and Sealed this

Twenty-fifth Day of November, 1986

*Attest:*

DONALD J. QUIGG

*Attesting Officer* *Commissioner of Patents and Trademarks*